United States Patent [19]

Chappars

[11] Patent Number: 4,505,424

[45] Date of Patent: Mar. 19, 1985

[54] CONTAINER FOR DISPLAYING AND STORING FLAT ARTICLES SELECTIVELY IN FLATTENED OR CYLINDRICAL FORM

[76] Inventor: George S. Chappars, 45 Windihill, Greensburg, Pa. 15601

[21] Appl. No.: 600,116

[22] Filed: Apr. 13, 1984

[51] Int. Cl.[3] ..... B65D 85/67; B65D 65/14; B65D 75/02

[52] U.S. Cl. ..... 229/87 R; 206/449; 206/412; 150/52 R; 229/87.5; 229/93

[58] Field of Search ..... 206/495, 412, 389, 44 R, 206/449; 229/87 R, 87.5; 150/52 R

[56] References Cited

U.S. PATENT DOCUMENTS

| | | | |
|---|---|---|---|
| 1,973,114 | 9/1934 | Sherman | 229/87 |
| 2,293,979 | 8/1942 | Hopkins | 206/44 R |
| 2,308,526 | 1/1943 | Look | 229/87.5 |
| 2,346,908 | 4/1944 | Corley | 150/52 R |
| 3,143,154 | 8/1964 | Best | 150/52 R |
| 3,185,197 | 5/1965 | Spiro et al. | 150/52 R |
| 3,270,791 | 9/1966 | Harris | 150/52 R |
| 4,467,917 | 8/1984 | Hayashi | 206/412 |

*Primary Examiner*—William T. Dixson, Jr.
*Attorney, Agent, or Firm*—H. Keith Hauger

[57] ABSTRACT

A container consisting of at least two layers of flexible material forming a pocket for retaining relatively flat articles, which also can be formed into a cylinder and retained in this position by providing adhering means in spot or strip form extending substantially along two overlapping edges, and inwardly from an overlapping edge for changing the diameter of the formed cylinder. External spot or strip adhering means also are provided to cooperate with that on the container for retaining the container in its flattened position.

14 Claims, 5 Drawing Figures

CONTAINER FOR DISPLAYING AND STORING FLAT ARTICLES SELECTIVELY IN FLATTENED OR CYLINDRICAL FORM

BACKGROUND OF THE INVENTION

The present invention relates to a container or package designed to retain a relatively flat article in either a cylindrical configuration or in a flattened form. More particularly, the invention relates to a flexible fabric, envelope-type container for receiving and retaining a flat article, such as a newspaper, certificate, diploma, etc., which container in its capsule or cylindrical form also has a desired diameter and fastening means to hold it in this predetermined diametrical position.

Memorable occasions, such as a birth, christening, bar mitzvah, graduation, wedding, or anniversary are often preserved or remembered by retaining a souvenir which may be the daily newspaper or magazine and/or the respective formal document bearing this commemorative date. If these documents are protected from the atmosphere over a long period of time, they become faded, yellowed, or brittle, and may eventually crumble or disintegrate.

In some instances, these papers or documents or parts thereof, are preserved in sealed glass frames which are breakable or in pre-formed cylinder containers which can be extremely bulky for displaying or storing in a drawer. Both types of containers can prove to be expensive to manufacture.

There are several flat non-breakable containers known in the industry which can be formed into a cylinder and these are disclosed in U.S. Pat. No. 2,293,979 issuing on Aug. 25, 1942, and U.S. Pat. No. 3,270,791 issuing on Sept. 6, 1966. The former patent discloses a container for attaching and retaining a map, and includes a complicated system of strips and snaps for its rolled and flattened positions. The latter patent discloses a container for retaining fabric goods, such as napkins or placemats, between several layers of transparent plastic sheets, which along with a cover are bonded or fastened at one end to a central rigid core over which the plastic sheets and cover are rolled and tied in place by straps wrapped around the core.

These containers of the prior art in the preceding paragraph can also be very expensive to manufacture, and in the case of the U.S. Pat. No. 3,270,791 patent, can also prove to be tremendously bulky since the rigid core does not permit the container to be conveniently fitted into a storage area smaller than the rolled form. In the U.S. Pat. No. 2,293,979 patent, as well as in the U.S. Pat. No. 3,270,791 patent, the fastening means used to retain the container in its rolled form is such that only a fixed diameter for the cylinder can be attained. And in the instance of the U.S. Pat. No. 2,293,979 patent, if the available storage area is less than this fixed diameter, then the container will have to be pushed in or collapsed in order for it to be fitted into this limited storage area.

SUMMARY OF THE INVENTION

It is, therefore, an object of the subject invention to eliminate the problems inherent with existing known flexible containers for storing relatively flat articles, which container can selectively be formed into either a cylinder or laid flat for use by a consumer or vendor by providing an inexpensive, non-breakable, flexible container consisting of simple material and reusable fastening means.

Another object of the subject invention is to provide a flexible container whose diameter can be varied to accommodate the available storage space where its bulkage is decreased for shipment or display purposes on a vendor's shelf or for display or storage by the consumer.

More particularly, it is an object of the subject invention to provide a container for retaining a relatively flat article, which container is selectively formed into a cylindrical configuration or into a flattened condition.

A still further object of the subject invention is to provide adhering means in spot or strip form, which adhering means are positioned along two overlapping edges of the layers of the formed pocket of the cylinder and can be caused to cooperate with similar adhering means provided on an external surface for affixing the container in varied cylindrical diameters.

And yet a further object of the present invention is to provide a container with adhering means, which when several stacked containers are in flattened form, their respective adhering means cooperate with that of an adjacent container for easy packaging and handling thereof, particularly for shipment or storage.

BRIEF DESCRIPTION OF THE DRAWINGS

These objects, as well as other novel features and advantages of the subject invention, will be better appreciated and understood when the following description is read along with the accompanying drawings, of which.

DETAILED DESCRIPTION OF PREFERRED EMBODIMENTS OF THE SUBJECT INVENTION

Figure 1:
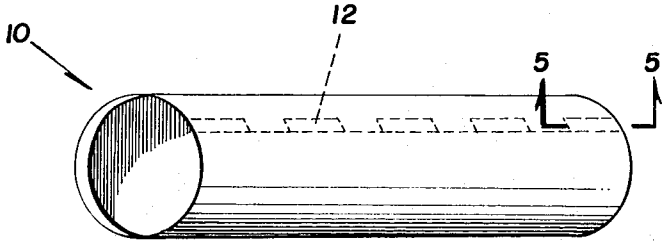
FIG. 1 is a perspective view of a rolled-up positioning for the subject invention.

FIG. 1 illustrates a schematic perspective view of container 10 shown to be rolled into a cylinder and held in this position by adhering strips or spots 12 which are fastened onto container 10, and more about which will be discussed shortly.

Figure 2:
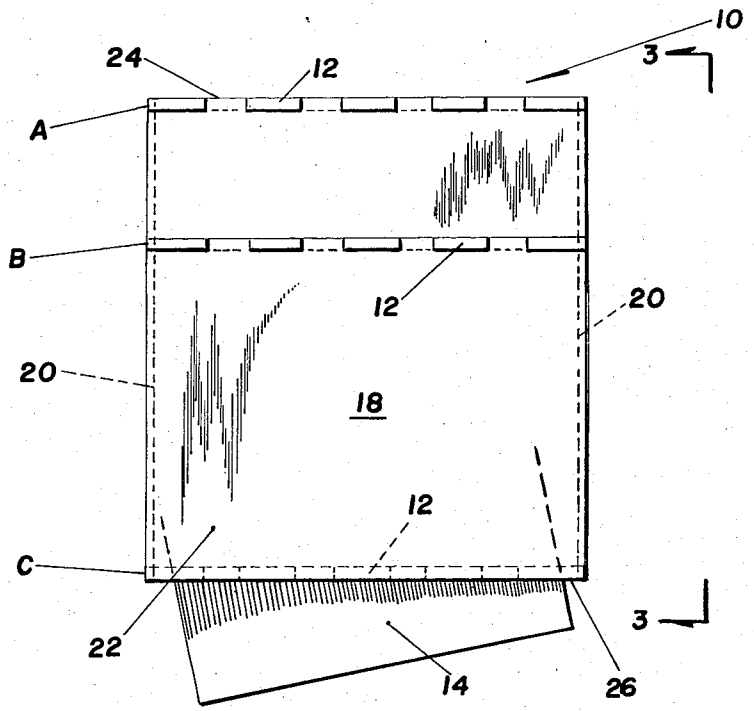
FIG. 2 is a front elevational view of a first embodiment of the subject invention in flattened form.
Figure 3:
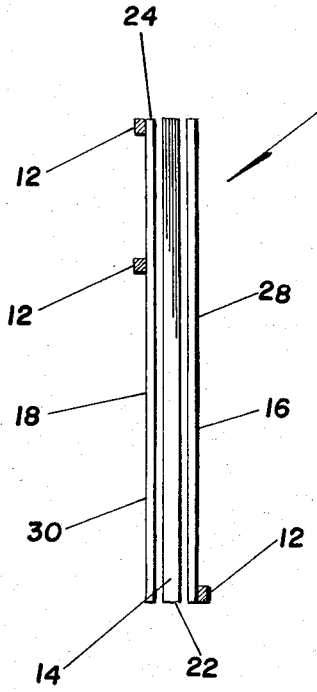
FIG. 3 is a side elevational view taken along lines 3—3 of FIG. 2.

FIGS. 2 and 3 illustrate container 10 in its flattened position which is the position it must take for the insertion and removal of newspaper 14, which as mentioned previously, may issue on the same day as the auspicious occasion which a consumer wishes to remember by keeping the newspaper as a souvenir. Container 10 and newspaper 14 can be bought separately and assembled by the consumer or a vendor for selling purposes.

Container 10 consists of two layers of fabric shaped into a quadrilateral or rectangle. In the embodiment of FIGS. 2 and 3, each layer 16, 18 are of the same width and length, and their two sides 20 are fastened to each other to form a pocket 22 (shown best in FIG. 3). Sides 20 can be connected by various means for instance, sewing, glueing or bonding. Both the top and bottom ends 24, 26 respectively of container 10 are opened. If newspaper 14 is substantially smaller than the formed pocket 22 where it is difficult to reach newspaper 14 for its removal, the two opposing longitudinal sides 20 forming pocket 22 can be moved towards each other causing top and bottom portions of each layer 16, 18 to move away from each other to the extent pocket 22 separates so that the consumer can reach deep into pocket 22 to remove newspaper 14.

On the outer surfaces 28, 30 of layers 16, 18 respectively, are severally arranged spaced-apart strips 12 of approximately the same size and located along top edge 24 of layer 18 and bottom edge 26 of layer 16. These strips 12 are also located inwardly from top edge 24 of outer surface 28. Strips 12 are of the "hook and loop" or "hook and pile" type of material. (An example is known as "Scotch-Mate" ®, manufactured by the 3-M Company of Farmington, Mich.)

Figure 5:
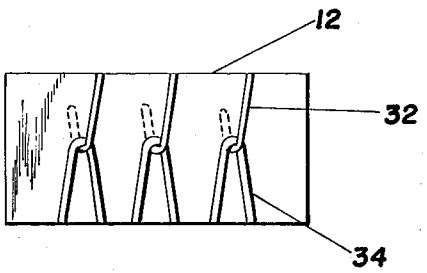
FIG. 5 is an enlargement of part of the subject invention taken along lines 5—5 of FIG. 1.

FIG. 5 shows in exaggerated, schematic form several hook-and-loops 32 and 34 which when layers 16 and 18 are pressed together, the material is such that a corresponding hook 32 and loop 34 frictionally engage in an adhering fashion, and a pulling action of layers 16 and 18 causes loop 34 to disengage hook 32. Strips 12 are durable and one strip 12 can be arranged to extend substantially across rows A, B, and C indicated in FIGS. 2 and 3. In view of the durability of strips 12, the likelihood that they will be torn off container 10 through misuse is lessened to a degree compared to those fastening means of the above prior art.

Figure 4:
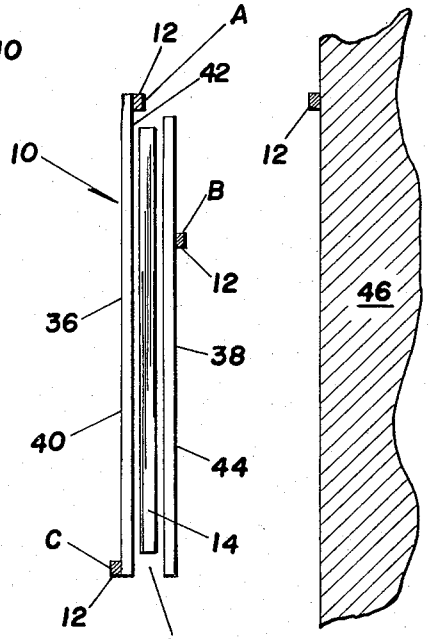
FIG. 4 is a side elevational view of a second embodiment of the subject invention in flattened form.

As shown in FIGS. 2–4, strips 12 are arranged transversely across layers 16 and 18, and each transverse row A, B, and C has the same number of strips 12. These strips 12 run in formation in a longitudinal direction so that when container 10 is formed into a cylinder with a maximum diameter as shown in FIG. 1, the several strips 12 along top row A of layer 18 adhere to corresponding strips 12 in bottom row C of layer 16 shown in FIGS. 2 and 3. Likewise, for a cylinder of a smaller diameter than that shown in FIG. 1, strips 12 in intermediate row B located on layer 18 inwardly from top row A are caused to adhere to those in bottom row C of layer 16.

Whereas, the embodiment of FIGS. 2 and 3 show equal rectangular layers 16, 18 with surface 30 of layer 18 having rows A and B of strips 12, and surface 28 of layer 16 with row C of strips, the embodiment of FIG. 4 differs basically in that layer 36 is longer than layer 38, and on its bottom outer surface 40 and a portion of a top outer surface 42 are arranged strip rows A and C, respectively, for forming a maximum diameter cylinder and on outer surface 44 of layer 38 is arranged an intermediate strip row B for a minimum diameter cylinder. In this latter embodiment of FIG. 4, the minimum diameter is obtained by turning the bottom edge of layers 36, 38 in a direction such that strips 12 in bottom row C correspond to adhere with those of intermediate row B of layer 38. For a maximum diameter, it is obvious that the bottom of layers 36, 38 are also rotated in a direction until strip row C is able to adhere to strip row A.

In this embodiment of FIG. 4, the two abutting longitudinal sides of layers 36, 38 are fastened together similarly to those of FIGS. 2 and 3 to form pocket 22 wherein the top and bottom portions are opened to permit access into pocket 22.

To form a cylinder for the container of FIGS. 2 and 3, bottom edge 26 of layers 16 and 18 are rotated in a direction to overlap top edge 24 of these layers. This operation is the same for container 10 of FIG. 4, however, the reverse overlapping occurs, i.e. the top edge overlaps the bottom edge.

Container 10 of both embodiments are shown to be in two layers. It is to be appreciated that one piece of fabric can be folded and fastened along the sides, and for that matter, along the bottom to form a pocket having three closed edge portions and an opened top portion. If container 10 is to be stationarily maintained in a flattened opened form as shown in FIGS. 2–4, then a row of strips 12 can be provided on an external surface 46, such as a wall or table top, and container 10 arranged so that one of its strip rows A, B, or C adhere to that on the external surface, as particularly shown in FIG. 4.

Even though layers 16, 18 of FIGS. 2 and 3, and layers 36, 38 of FIG. 4 are shown to be completely opaque, it is also feasible to provide an opened window in one of the layers so that newspaper 14 can be visibly displayed when container 10 is in its flattened form. This type of design for container 10 would be ideal for a consumer who wishes to display the container 10 on a wall.

The type of material for layers 16, 18, 36, 38 can be of a non-woven, inexpensive fabric such as treated burlap or other material which possesses the rigidity required for retaining container 10 in cylindrical form.

As stated previously, the arrangement of strip rows A, B, and C are so positioned that cylinder 10 can be formed into a small diameter which is ideal for accommodating a modest size local newspaper or into a larger diameter for a thicker metropolitan edition.

Due to the capability of container 10 to be formed into a cylinder having varied diameters, it can be appreciated that container 10 can be made to fit into a wide range of storage area. In addition, container 10 has the versatility to be used in flattened form and placed into a drawer or atop a table surface, or used as a frame on a wall for displaying and protecting newspaper 14.

Newspaper 14 is shown in drawings 2–4; but as mentioned earlier, any document or flat article can be inserted into pocket 22. A manufacturer can ship container 10 in stack form where each container 10 is arranged relative to its adjacent container 10 in a fashion so that the "hook and pile" material strips 12 on one layer of container 10 adheres to those of the adjacent container such that the containers 10 are prevented from sliding off each other in the stack.

In describing the present invention, strips 12 are referred to as being "hook and pile" material, but it is to be appreciated that strips 12 can consist of any suitable glue compound.

In accordance with the patent statutes, I have explained the principle and operation of my invention, and have illustrated and described what I consider to represent the best embodiment thereof;

I claim:

1. A container for retaining a relatively flat article, which container is selectively formed into a cylindrical configuration or into a flattened condition, comprising:

at least two cooperative opposing quadrilateral layers of flexible material constructed and arranged relative to each other in a manner to form a pocket therebetween for receiving and retaining said article, and adhering means along different opposite edge portions of a first and a second outer surface of said formed pocket when in said flattened form constructed and arranged in a manner that upon an overlapping of said two edge portions causing said first and second surfaces to abut each other for the forming of said cylindrical configuration, said adhering means cooperate with each other to hold said first outer surface along its said edge portion to said second outer surface along its said edge portion to retain said cylindrical configuration.

2. A container according to claim 1, wherein said formed cylindrical configuration has a maximum diameter for said container, and wherein said adhering means further includes means spaced inwardly from and parallel to said adhering means on said edge portion of said first outer surface constructed and arranged in a manner to cooperate with said adhering means on said edge portion of said second outer surface to form said cylindrical configuration having a diameter less than said maximum diameter when said adhering means on said edge portion of said first surface is inoperative with respect to said adhering means on said edge portion of said second outer surface.

3. A container according to claims 1 or 2, wherein said adhering means are arranged substantially across said formed pocket.

4. A container according to claim 3, wherein said adhering means consists of several hook and loop arrangements which interlock with those of a said cooperative adhering means.

5. A container according to claim 3, wherein said adhering means is composed of a glue compound.

6. A container according to claim 1, wherein each said layer has parallel equal top and bottom edges and parallel equal sides edges which cooperate with corresponding edges of said opposing layer, and wherein said side edges are connected together to form said pocket.

7. In combination with a container according to claim 1, wherein said adhering means further includes means mounted on an external surface constructed and arranged to cooperate with any of said adhering means on said surfaces of said container for positioning and maintaining said container in said flattened condition.

8. In combination according to claim 7, wherein said adhering means on said external surface and on said surfaces of said container consists of several hook and loop arrangements interlocking with those of a respective cooperative adhering means.

9. In combination according to claim 1, wherein said adhering means on said external surface and on said surfaces of said container is composed of a glue compound.

10. A container according to claim 6, wherein said adhering means on said first outer surface is along a said top edge and said adhering means on said second outer surface is along a said bottom edge.

11. A container according to claim 10, wherein said top and bottom parallel edges of said first and second outer surfaces, respectively, are on a same layer of said two opposing layers.

12. A container according to claim 10, wherein said top and bottom parallel edges of said first and said second outer surfaces, respectively, are on a different layer of said two opposing layers.

13. A container according to claim 12, wherein the lateral and longitudinal dimensions of one said layer are equal to those of their opposing layers.

14. A container according to claim 11, wherein the lateral dimension of one said layer is equal to its opposing layer and the longitudinal dimension of each said two layers are unequal relative to each other, whereby said same layer having said first and said second outer surfaces has a greater longitudinal dimension than its said opposing layer.

* * * * *